US012344909B2

(12) United States Patent
Shingaki et al.

(10) Patent No.: US 12,344,909 B2
(45) Date of Patent: Jul. 1, 2025

(54) METHOD FOR PRODUCING GRAIN-ORIENTED ELECTRICAL STEEL SHEET AND COLD-ROLLING FACILITY

(71) Applicant: JFE Steel Corporation, Tokyo (JP)

(72) Inventors: Yukihiro Shingaki, Tokyo (JP); Yusuke Shimoyama, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 18/735,904

(22) Filed: Jun. 6, 2024

(65) Prior Publication Data

US 2024/0327942 A1 Oct. 3, 2024

Related U.S. Application Data

(62) Division of application No. 17/279,194, filed as application No. PCT/JP2019/037752 on Sep. 26, 2019, now Pat. No. 12,037,654.

(30) Foreign Application Priority Data

Sep. 28, 2018 (JP) ..... 2018-183898

(51) Int. Cl.
*C21D 8/12* (2006.01)
*C22C 38/00* (2006.01)
(Continued)

(52) U.S. Cl.
CPC ..... *C21D 8/1222* (2013.01); *C21D 8/1205* (2013.01); *C21D 8/1233* (2013.01);
(Continued)

(58) Field of Classification Search
None
See application file for complete search history.

(56) References Cited

U.S. PATENT DOCUMENTS 3,856,568 A 12/1974 Tanaka et al.
3,933,024 A 1/1976 Matsumoto et al.
(Continued)

FOREIGN PATENT DOCUMENTS

CN 108359896 A 8/2018
JP 5016610 B2 2/1975
(Continued)

OTHER PUBLICATIONS

Chinese Office Action for Chinese Application No. 201980063014.9, dated Jul. 22, 2022 with Search Report, 12 pages.
(Continued)

*Primary Examiner* — Anthony M Liang
(74) *Attorney, Agent, or Firm* — Buchanan Ingersoll & Rooney PC

(57) ABSTRACT

In a method of producing a grain-oriented electrical steel sheet comprising subjecting a steel slab containing no inhibitor-forming components to hot rolling, cold rolling, primary recrystallization annealing working also as decarburization and to final annealing causing secondary recrystallization after applying an annealing separator on the surface, the final cold rolling for cold rolling the steel sheet to the final thickness uses a warm rolling with a tandem rolling mill at a total rolling reduction of not less than 80% at 150 to 280° C. and is performed by extending a pass line length of the steel sheet between the stands so that T satisfies $T \geq 1.3 \times L/V$, where an distance between the stands is defined as L(m), a speed of the steel sheet passing between the stands is defined as V (mpm), and a pass time during which the steel sheet passes between the stands is defined as T(min).

4 Claims, 1 Drawing Sheet

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/48*** | (2006.01) |

(52) U.S. Cl.

CPC ..... *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/48* (2013.01); *C21D 2201/05* (2013.01)

(56) References Cited

U.S. PATENT DOCUMENTS

| | | | |
|---|---|---|---|
| 4,098,929 | A | 7/1978 | Badone et al. |
| 2001/0030001 | A1 | 10/2001 | Hayakawa et al. |
| 2006/0053617 | A1 | 3/2006 | Richert |
| 2010/0084058 | A1 | 4/2010 | Mukai et al. |
| 2015/0187473 | A1 | 7/2015 | Imamura et al. |

FOREIGN PATENT DOCUMENTS

| | | | | |
|---|---|---|---|---|
| JP | 5079422 | B2 | | 6/1975 |
| JP | 5365245 | A | | 6/1978 |
| JP | 5429182 | B2 | | 9/1979 |
| JP | 01215925 | A | | 8/1989 |
| JP | 08253816 | A | | 10/1996 |
| JP | 2000129356 | A | | 5/2000 |
| JP | 2003253341 | A | | 9/2003 |
| JP | 2006095544 | A | | 4/2006 |
| JP | 4839338 | B2 | | 12/2011 |
| JP | 2012184497 | A | | 9/2012 |
| JP | 5413846 | B2 | | 2/2014 |
| JP | 2014114490 | A | | 6/2014 |
| JP | 2014173103 | A | * | 9/2014 |
| RU | 2350415 | C2 | | 3/2009 |
| RU | 2411092 | C1 | | 2/2011 |

OTHER PUBLICATIONS

Extended European Search Report for European Application No. 19865374.3, dated Jun. 30, 2021, 10 pages.

International Search Report and Written Opinion for International Application No. PCT/JP2019/037752, dated Nov. 5, 2019, 4 pages.

Korean Request for the Submission of an Opinion for Korean Application No. 10-2021-7007131, dated Sep. 27, 2022, with translation, 8 pages.

Russian Office Action for Russian Application No. 2021111916, issued Oct. 15, 2021, 6 pages.

* cited by examiner

METHOD FOR PRODUCING GRAIN-ORIENTED ELECTRICAL STEEL SHEET AND COLD-ROLLING FACILITY

CROSS REFERENCE TO RELATED APPLICATIONS

This is a Divisional Applications of U.S. patent application Ser. No. 17/279,194, filed Mar. 24, 2021, which is a U.S. National Phase application of PCT/JP2019/037752, filed Sep. 26, 2019, which claims priority to Japanese Patent Application No. 2018-183898, filed Sep. 28, 2018, the disclosures of these applications being incorporated herein by reference in their entireties for all purposes.

FIELD OF THE INVENTION

This invention relates to a method for producing a grain-oriented electrical steel sheet with excellent magnetic properties and a cold-rolling facility used in the production method.

BACKGROUND OF THE INVENTION

A grain-oriented electrical steel sheet has excellent magnetic properties with a crystal texture (Goss orientation) in which the <001> orientation as a magnetic easy axis is highly accumulated in the rolling direction of the steel sheet. The grain-oriented electrical steel sheet is usually produced using a steel material with a chemical composition comprising approximately not more than 4.5 mass % Si and other components that form a so-called inhibitor such as MnS, MnSe, and AlN to cause secondary recrystallization.

Patent Literature 1 proposes a method (inhibitor-less method) that can cause secondary recrystallization in a steel material not containing the above-described inhibitor-forming components. The inhibitor-less method uses highly-purified steel material and causes secondary recrystallization by texture control to thereby eliminate a high-temperature heating of slab before hot rolling. Thus, the method makes it possible to produce a grain-oriented electrical steel sheet at a low cost, while the method requires delicate condition control to produce the texture.

In the method for producing the grain-oriented electrical steel sheet using a steel material not containing inhibitor-forming components, the quality of the texture has a large influence on the quality of the magnetic properties. A method for forming good texture includes, for example, a method disclosed in Patent Literature 2 performing heat treatment (aging treatment) on a cold-rolled sheet at a low temperature during rolling. The method aims to diffuse solid-solution elements such as carbon and nitrogen at low temperature to segregate on the dislocation introduced by the rolling and to prevent dislocation migration, thereby promoting shear deformation in subsequent rollings for an improvement of rolled texture. Patent Literature 3 discloses a method in which a cooling rate in a hot-band annealing or in an annealing before a finish cold rolling (final cold rolling) is set to not less than 30° C./s and further inter-pass aging of maintaining a sheet temperature within 150 to 300° C. for not less than 2 minutes is repeated twice or more times in the finish cold rolling. Moreover, Patent Literature 4 proposes a method in which a steel sheet temperature during rolling is set to high (warm rolling) to utilize a dynamic aging effect of immediately fixing dislocation introduced by the rolling, by carbon or nitrogen.

In each of the above method in which the texture is controlled, the steel sheet is maintained at an appropriate temperature during the rolling or during the pass between rollings to precipitate carbon and nitrogen on the dislocation and inhibit the migration of the dislocation, so that shear deformation can be promoted. By applying these methods, (111) fiber texture, which is called γ-fiber in the primary recrystallized texture after cold rolling, is reduced, and the existence frequency of {110}<001> (Goss orientation) can be increased.

As described above, the cold rolling process is a very important process from the viewpoint of the texture control. To perform the final cold rolling for rolling to the final sheet thickness (product thickness), there are widely used a reverse rolling mill (Patent Literature 5), and a tandem rolling mill (Patent Literature 6) which is configured by arranging multiple stands (also referred as "std") in series. Comparing the two rolling mills from the viewpoint of improving the texture, the reverse rolling mill is considered to be advantageous in the point that the steel sheet can be held for a long period of time in a state of being wound into a coil after one pass rolling and then subjected to the so-called aging treatment.

PATENT LITERATURE

Patent Literature 1: JP-A-2000-129356
Patent Literature 2: JP-A-S50-016610
Patent Literature 3: JP-A-H08-253816
Patent Literature 4: JP-A-H01-215925
Patent Literature 5: JP-A-S54-013846
Patent Literature 6: JP-A-S54-029182

SUMMARY OF THE INVENTION

When the tandem rolling mill is used in cold rolling, the time (pass time) during which a steel sheet passes between multiple stands constituting the rolling mill can be calculated as long as the feeding speed of the steel sheet to stand #1, and the rolling speed or the rolling reduction distribution of each stand, in addition to an inter-stand distance which is the specification of the rolling mill, are specified. For example, when a steel sheet with a thickness of 2 mm is to be rolled by a five stand tandem rolling mill configured by arranging five stands at 1.5 m intervals, assuming that the feeding speed of the steel sheet at the entry side of stand #1 is 100 mpm and the rolling reduction of each stand is 25%, the sheet thickness is 1.5 mm and the steel sheet speed is about 133 mpm at the exit side of stand #1 and the pass time for the steel sheet to pass between stand #1 and stand #2 is about 0.675 seconds. Calculated in the same way, at the exit side of stand #4, the sheet thickness is 0.63 mm and the steel sheet speed is 316 mpm, and the pass time for the steel sheet to pass between stand #4 and stand #5 is about 0.285 seconds, which is a very short time.

In order to precipitate carbon and nitrogen on the dislocation to fix the dislocation, and promote shear deformation to improve the texture as described above, high temperature and sufficient time are required for diffusion of carbon and nitrogen. As above, however, it is difficult to ensure sufficient time for diffusion in tandem rolling. In particular, it is theoretically expected that the above texture improvement effect is larger in the later rolling stages having a larger amount of introduced dislocation than in the earlier rolling stages having a smaller amount of introduced dislocation. In the tandem rolling mill, the steel sheet speed between the stands is higher and the pass time is shorter at the later stages, so that it is extremely difficult to expect improvement in the texture.

Aspects of the invention are made in view of the above problem inherent to the prior arts, and an object thereof is to provide a method of producing a grain-oriented electrical steel sheet that can effectively exhibit inter-pass aging and obtain excellent magnetic properties even when a tandem rolling mill is employed for cold rolling in a production of a grain-oriented electrical steel sheet using an inhibitor-less steel material, and a cold-rolling facility for using the method.

In order to solve the problem, the inventors have closely studied a method of producing a grain-oriented electrical steel sheet in which the texture control is very important and a steel material not including inhibitor-forming components is used, by applying a tandem rolling mill to the final cold rolling and focusing on the influence of aging conditions between the stands in the tandem rolling mill upon the primary recrystallization texture. As a result, the inventors have found that even when the tandem rolling mill is used in the final cold rolling, the pass time between the stands, or aging time works effectively to improve primary recrystallization texture, no matter how slight the extended time is, and in particular, the texture improving effect by the extension of the pass time is larger at the later stage, where the total rolling reduction is large, in the tandem roll mill, and reached the present invention.

That is, aspects of the present invention include a method of producing a grain-oriented electrical steel sheet comprising reheating a steel slab comprising C: 0.01 to 0.10 mas %, Si: 2.0 to 4.5 mass %, Mn: 0.01 to 0.5 mass %, sol. Al: not less than 0.0020 mass % and less than 0.0100 mass %, N: less than 0.0080 mass %, each of S, Se, and O: less than 0.0050 mass %, and the residue being Fe and inevitable impurities to a temperature of not higher than 1300° C., subjecting the slab to hot rolling and then one cold rolling or more cold rollings having an intermediate annealing between each rolling to form a cold-rolled sheet with a final thickness, and subjecting the cold-rolled sheet to a primary recrystallization annealing working also as decarburization and to a final annealing causing secondary recrystallization after applying an annealing separator on the surface of the steel sheet, in which the final cold rolling for cold rolling the steel sheet to the final thickness is performed by using a tandem rolling mill such that at a total rolling reduction is not less than 80% and at least one of the sheet temperatures between stands thereof is within 150 to 280° C. and by extending a pass line length of the steel sheet between the stands so as to satisfy the following equation (1):

$$T \geq 1.3 \times L/V, \quad (1)$$

where a distance between the stands is defined as L(m), a speed of the steel sheet passing between the stands is defined as V (mpm), and a pass time during which the steel sheet passes between the stands is defined as T(min).

The method of producing a grain-oriented electrical steel sheet according to aspects of the invention is characterized in that the extension of the pass line length of the steel sheet is performed between the stands where the total rolling reduction reaches not less than 66%.

The method of producing a grain-oriented electrical steel sheet according to aspects of the invention is characterized in that the steel slab used in the method further contains one or more selected from Ni: 0.005 to 1.50 mass %, Sn: 0.005 to 0.50 mass %, Nb: 0.0005 to 0.0100 mass %, Mo: 0.01 to 0.50 mass %, Sb: 0.005 to 0.50 mass %, Cu: 0.01 to 1.50 mass %, P: 0.005 to 0.150 mass %, Cr: 0.01 to 1.50 mass %, and Bi: 0.0005 to 0.05 mass % in addition to the above chemical composition.

Aspects of the present invention also include a cold-rolling facility for cold rolling a steel sheet to the final thickness. The cold-rolling facility is a tandem rolling mill comprised of a plurality of stands in which;

a pass line extension mechanism for extending a pass line length of the steel sheet between the stands to be longer than a distance between the stands is disposed in at least one section between the stands of the tandem rolling mill;

at least two or more movable rolls for changing the pass line are disposed; and at least one of the movable rolls is disposed at a side opposite to another roll with respect to a reference horizontal pass line.

The cold-rolling facility according to aspects of the invention is characterized in that at least one of the movable rolls for changing the pass line disposed between the stands has a heating mechanism.

The pass line extension mechanism in the cold-rolling facility according to aspects of the invention is characterized in that the pass line extension mechanism can extend the pass line length of the steel sheet between the stands to not less than 1.3 times longer than the distance between the stands.

The cold-rolling facility according to aspects of the invention is characterized in that the pass line extension mechanism is disposed between the stands where the total rolling reduction reaches not less than 66%.

The cold-rolling facility according to aspects of the invention is characterized in that the steel sheet to be rolled is an electrical steel sheet.

Aspects of the present invention allows the texture to improve through the inter-pass aging even in the final cold rolling using a tandem rolling mill which has a high productivity, resulting that a grain-oriented electrical steel sheet having an excellent iron loss property can be produced at a low cost.

DETAILED DESCRIPTION OF EMBODIMENTS OF THE INVENTION

Figure 1:
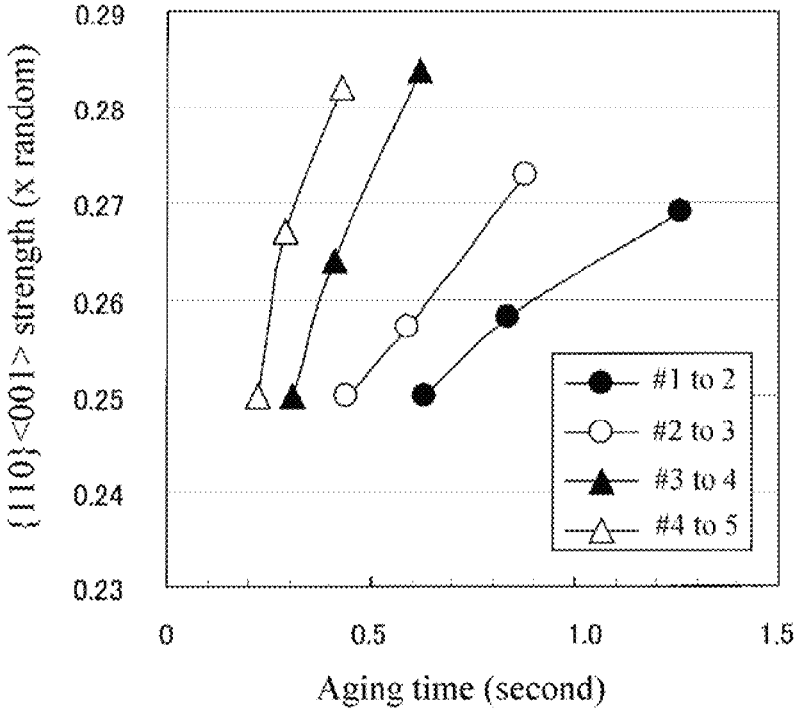
FIG. 1 is a graph showing a relation between an inter-pass aging time in a tandem rolling mill and a {110}<001> intensity.

First, an experiment that has led to development of aspects of the invention will be described below.

The inventors have conducted the following experiment in a method for producing a grain-oriented electrical steel sheet, where the texture control is particularly important, assuming a tandem rolling and using steel material not containing inhibitor-forming components.

EXPERIMENT

A steel slab containing C: 0.050 mass %, Si: 3.3 mass %, Mn: 0.04 mass %, sol. Al: 0.0050 mass %, N: less than 0.0025, S, Se and O: less than 0.0050 mass % each, and the residue being Fe and inevitable impurities and not containing inhibitor-forming components is reheated to 1100° C. and hot rolled to form a hot-rolled sheet having a sheet thickness of 1.8 mm. The hot-rolled sheet is then subjected to a hot-band annealing at 1000° C. for 70 seconds.

Next, a sample is taken out from the hot-rolled sheet after the hot-band annealing to perform five pass rolling that simulates a cold rolling using a five stand tandem rolling mill to roll the sheet to a final thickness of 0.30 mm.

In the rolling, the steel sheet feeding rate at the first pass is set to 100 mpm, and the rolling reduction in each pass from the first pass to the fifth pass is set to 30% (constant). Other rolling conditions for each pass are varied as shown in Table 1.

TABLE 1

| Item | Rolling condition | | | | |
|---|---|---|---|---|---|
| | 1st pass | 2nd pass | 3rd pass | 4th pass | 5th pass |
| Sheet thickness (mm) at entry side | 1.80 | 1.26 | 0.88 | 0.62 | 0.43 |
| Sheet thickness (mm) at exit side | 1.26 | 0.88 | 0.62 | 0.43 | 0.30 |
| Rolling reduction (%) | 30 | 30 | 30 | 30 | 30 |
| Total rolling reduction (%) | 30 | 51 | 66 | 76 | 83 |
| Steel sheet speed (mpm) at exit side | 143 | 204 | 292 | 416 | 595 |

The time required for the steel sheet to pass from the 1st pass to the 2nd pass, from the 2nd pass to the 3rd pass, from the 3rd pass to the 4th pass, and from the 4th pass to the 5th pass (inter-pass time) are varied as shown in Table 2, assuming that the distance between each stand of the five stand tandem rolling mill is assumed to three levels: 1.5 m, 2.0 m and 3.0 m.

TABLE 2

| Level | Assumed distance between stands (m) | Inter-pass time (sec) | | | |
|---|---|---|---|---|---|
| | | $1^{st}$ pass to 2nd pass | $2^{nd}$ pass to 3rd pass | 3rd pass to 4th pass | 4th pass to 5th pass |
| A | 1.5 | 0.63 | 0.44 | 0.31 | 0.22 |
| B | 2.0 | 0.84 | 0.59 | 0.41 | 0.29 |
| C | 3.0 | 1.26 | 0.88 | 0.62 | 0.43 |

In the rolling experiment, the sheet temperature at the exit side of each pass from the 1st pass to the 5th pass is controlled to be 200° C. (constant). Accordingly, at the level A in Table 2, the steel sheet after each pass is thus subjected to inter-pass aging, at a temperature of 200° C., for 0.63 seconds from the 1st pass to the 2nd pass, for 0.44 seconds from the 2nd pass to the 3rd pass, for 0.31 seconds from the 3rd pass to the 4th pass, and for 0.22 seconds from the 4th pass to the 5th pass. At the level B, the steel sheet is subjected to inter-pass aging, at a temperature of 200° C., for 0.84 seconds from the 1st pass to the 2nd pass, for 0.59 seconds from the 2nd pass to the 3rd pass, for 0.41 seconds from the 3rd pass to the 4th pass, 0.29 seconds from the 4th pass to the 5th pass. At the level C, the steel sheet is subjected to inter-pass aging, at a temperature of 200° C., for 1.26 seconds from the 1st pass to the 2nd pass, for 0.88 seconds from the 2nd pass to the 3rd pass, for 0.62 seconds from the 3rd pass to the 4th pass, 0.43 seconds from the 4th pass to the 5th pass.

The cold-rolled sheet, which has been thus rolled to the final thickness of 0.30 mm, is then subjected to a primary recrystallization annealing also working as a decarburization annealing at 840° C. for 100 seconds under a wet hydrogen atmosphere, followed by the measurement of X-ray pole figures. Then, from the obtained data, a crystallite orientation distribution function (ODF) is generated using a ADC method, and, the values of $\Phi=90°$ and $\Phi1=90°$ for the $\Phi2=45°$ cross section are determined by using the Euler space thereof. The above value is one of the indicators of the amount of {110}<001> orientation to be the nucleus of secondary recrystallization, and the higher the value the better the texture of the steel sheet after primary recrystallization annealing. An increase in the number of secondary recrystallization nuclei also means that the iron loss property is improved because the origin of secondary recrystallization increases and the secondary recrystallization grains become small.

The measurement result is shown in FIG. 1. As seen from FIG. 1, the {110} <001> intensity increases by extending the distance between the stands from about 1.5 m of level A to about 2.0 m of level B, that is, extending the pass time (aging time) between the stands by not less than 1.3 times, resulting in an improvement in the texture. Moreover, even within the same level, the increase rate of the {110}<001> strength is higher from the third pass to the fourth pass and from the fourth pass to the fifth pass in the later stages where the total rolling reduction during rolling is not less than 66%, indicating that the effect of improving the texture is larger.

The experiment result shows that it is possible to improve the texture, even when the pass time between the stands is extremely short as in tandem rolling, by increasing the inter-pass time, i.e., by increasing the aging time between the passes. However, as previously described, the inter-pass time (aging time) in the tandem rolling mill is unambiguously determined by the facility specifications and rolling schedule thereof, so that there is no flexibility to change only the aging time.

Figure 2:
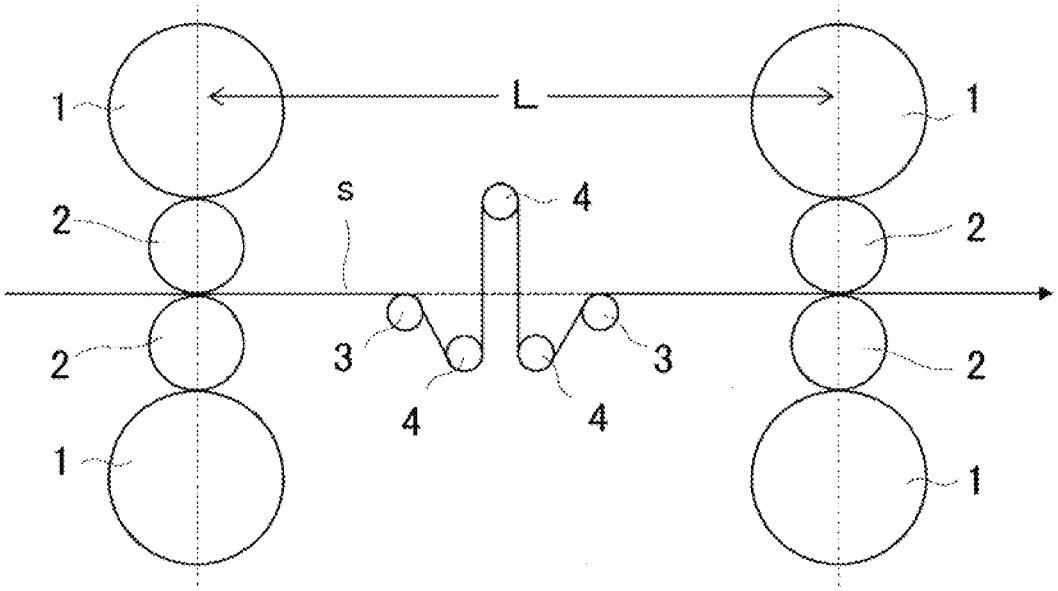
FIG. 2 is a view illustrating an example of a tandem rolling mill having a pass line extension mechanism according to aspects of the invention.

The inventors have further studied a method for changing the inter-pass time (aging time) in cold rolling using a tandem mill, and as a result, conceived "a pass line extension mechanism" shown in FIG. 2. FIG. 2 shows an extract of two stands from the tandem rolling mill, where a pass line extension mechanism configured of a fixed roll 3 and movable roll 4 is provided between the two stands. The pass line extension mechanism has a function of bending the reference horizontal pass line (the straight line connecting each contact point between the upper and lower work rolls of the stand) between the stands in normal rolling, by moving the movable roll 4 upward and downward and extending the length of the steel sheet present between the two stands (the pass line length) more than the pass line length of the steel sheet S in normal rolling (the inter-stand distance L). The pass line extension mechanism is similar to a tension control mechanism provided between the stands of the tandem rolling mill, but the tension control mechanism cannot extend the pass line length to not less than 1.3 times length of the inter-stand distance.

Aspects of the present invention were developed in view of above new knowledge.

Next, the chemical composition of a steel material (slab) used in a production of a grain-oriented electrical steel sheet according to aspects of the invention will be explained below.

C: 0.01 to 0.10 Mass %

C is an element effective for an improvement in primary recrystallization texture, and needs to be contained at least by 0.01 mass %. However, the C content exceeding 0.10 mass % rather causes deterioration in the primary recrystallization texture. Therefore, the C content falls within the range of 0.01 to 0.10 mass %. From a viewpoint of considering the magnetic properties important, the C content preferably falls within the range of 0.01 to 0.06 mass %.

Si: 2.0 to 4.5 Mass %

Si is an element effective for an increase in specific resistance of steel and decrease in iron loss, and contained by not less than 2.0 mass % in accordance with aspects of the invention. The Si content exceeding 4.5 mass % causes a remarkable decrease in cold rolling properties. Therefore, the Si content falls within the range of 2.0 to 4.5 mass %, preferably 2.5 to 4.0 mass %.

Mn: 0.01 to 0.5 Mass %

Mn is an element having an effect of improving workability in hot rolling, and moreover, controlling an oxide film formation in primary recrystallization annealing, leading to promote a formation of forsterite coating during secondary recrystallization. In view of obtaining the above effect, therefore, Mn needs to be contained by not less than 0.01 mass %. However, the Mn content exceeding 0.5 mass % causes deterioration of primary recrystallization texture, leading to deterioration of the magnetic properties. Therefore, the Mn content falls within the range of 0.01 to 0.5 mass %, preferably 0.03 to 0.3 mass %.

Sol. Al: Not Less than 0.0020 Mass % and Less than 0.0100 Mass %

Al has a high affinity for oxygen. When a small amount of Al is added in the steelmaking process, the amount of dissolved oxygen in steel is reduced and oxide-based inclusions, which lead to degradation of iron-loss property, are decreased, and thus, Al needs to be contained by not less than 0.0020 mass % in the form of sol. Al. However, since Al forms a dense oxide film on the surface of the steel sheet to thereby inhibit decarburization, the amount of Al is limited to less than 0.0100 mass % in the form of sol. Al. Al preferably falls within the range of 0.0030 to 0.0090 mass % in the form of sol. Al.

N: Less than 0.0080 Mass %

N is an unnecessary element in accordance with aspects of the invention. When the N content, which forms a nitride, is not less than 0.0080 mass %, grain boundary segregation and the formation of nitride are caused, resulting in a harmful influence such as deterioration of the texture, and further leading to a defect such as a blister in the slab heating. Therefore, the N content is limited to less than 0.0080 mass %. Preferably, it is not more than 0.0060 mass %.

S, Se and O: Less than 0.0050 Mass % Each

S, Se and O are elements that form a precipitate to be an inhibitor and form an oxide. When each element reaches not less than 0.0050 mass %, the precipitate that has been coarsened in the slab heating such as MnS, MnSe or the like, and a coarse oxide make the primary recrystallization texture non-uniform, making it difficult to develop secondary recrystallization. Therefore, each of S, Se and O is limited to less than 0.0050 mass %, preferably, not more than 0.0030 mass %.

Steel material used in a production of a grain-oriented electrical steel sheet according to aspects of the invention contains Fe and inevitable impurities as the residue other than the above components. However, as being effective for an improvement in coating properties and magnetic properties, the components described below may be contained in the following ranges.

Ni: 0.005 to 1.50 Mass %

Ni has an effect of improving magnetic properties by increasing the uniformity of the structure of a hot-rolled steel sheet, and can be contained by not less than 0.005 mass % to obtain the effect. However, the Ni content exceeding 1.50 mass % causes difficulties in secondary recrystallization to deteriorate magnetic properties. Therefore, Ni is preferably contained in the range of 0.005 to 1.50 mass %, more preferably 0.01 to 1.0 mass %.

Sn: 0.005 to 0.50 Mass %

Sn has an effect of improving magnetic properties by suppressing nitriding and oxidation of a steel sheet in secondary recrystallization annealing and promoting the formation of secondary recrystallized grains having excellent crystal orientation. The effect can be obtained when S is contained by not less than 0.005 mass %, while the Sn content exceeding 0.50 mass % causes a decrease in the cold rolling property. Therefore, Sn is preferably contained in the range of 0.005 to 0.50 mass %, more preferably 0.01 to 0.30 mass %.

Nb: 0.0005 to 0.0100 Mass %, Mo: 0.01 to 0.50 Mass %

Nb and Mo have an effect of preventing a formation of scab in hot rolling by suppressing surface cracking of the slab caused in the heating of the slab. The effect can be obtained when the Nb content and Mo content are not less than 0.0005 mass % and not less than 0.01 mass %, respectively. The Nb content exceeding 0.0100 mass % and the Mo content exceeding 0.50 mass %, causes a large increase in the generation amounts of carbide and nitride, which remain in a final product to cause deterioration of iron loss. Therefore, it is preferable that Nb and Mo fall within the range of 0.0005 to 0.0100 mass % and 0.01 to 0.50 mass %, respectively. More preferable Mo range is 0.01 to 0.30 mass %.

Sb: 0.005 to 0.50 Mas %

Sb has an effect of suppressing oxidation of the steel sheet surface. As preventing oxidation and nitriding in secondary recrystallization, Sb also has an effect of promoting the growth of the secondary recrystallization, which has a good crystal orientation, and improving the magnetic properties. In order to obtain the effect, Sb is preferably contained by not less than 0.005 mass %. However, the Sb content exceeding 0.50 mass % leads to a decrease in cold rolling property. Thus, Sb is preferably contained in the range of 0.005 mass % to 0.50 mass %, more preferably 0.01 to 0.30 mass %.

Cu: 0.01 to 1.50 Mass %

Cu has an effect, similarly to Sb, of suppressing oxidation on the steel sheet surface. Cu suppresses oxidation on the steel sheet surface in secondary recrystallization annealing to thereby promote the growth of secondary recrystallization having a good crystal orientation, resulting an effect of increasing magnetic properties. The above effect can be obtained when Cu is contained by not less than 0.01 mass %. However, the content exceeding 1.50 mass % causes decrease in hot rolling properties. Thus, Cu is preferably contained in the range of 0.01 to 1.50 mass %, more preferably in the range of 0.01 to 1.0 mass %.

P: 0.005 to 0.150 Mass %

P has an effect of stabilizing the formation of a forsterite coating through the formation of subscale in decarburization annealing. The P content of not less than 0.005 mass % develops the above effect, while the P content exceeding 0.150 mass % causes deterioration of cold rolling properties. Therefore, P is preferably contained in the range of 0.005 to 0.150 mass %, more preferably 0.01 to 0.10 mass %.

Cr: 0.01 to 1.50 Mass %

Cr has an effect of stabilizing the formation of a forsterite coating through the formation of subscale in decarburization annealing. The Cr content of not less than 0.01 mass % allows the above effect to be obtained, while the Cr content exceeding 1.50 mass % makes it difficult to cause secondary recrystallization, resulting in deterioration of magnetic properties. Therefore, Cr is preferably contained in the range of 0.01 to 1.50 mass %, more preferably 0.01 to 1.0 mass %.

Bi: 0.0005 to 0.05 Mass %

Bi is an element effective for an improvement in magnetic properties, and can be contained as necessary. The effect is small with less than 0.0005 mass % Bi, while Bi exceeding 0.05 mass % hinders the formation of forsterite coating. Therefore, Bi is preferably contained in the range of 0.0005 to 0.05 mass %, more preferably 0.001 to 0.03 mass %.

Next, the method for producing a grain-oriented electrical steel sheet according to aspects of the invention will be described below.

Steel adjusted to have the chemical composition described above conforming to aspects of the invention is melt by a usual refining process, and formed into steel material (slab) by a continuous casting method or an ingot making—blooming method.

Next, the slab is subjected to hot rolling after reheated or without reheated. When the slab is reheated, the reheating temperature preferably falls within the range of 1000 to 1300° C. In accordance with aspects of the present invention which uses steel material hardly having inhibitor-forming components, the slab heating at above 1300° C. makes no technical sense, only leading to increase in the cost. On the other hand, slab heating below 1000° C. increases the load of hot rolling and makes rolling difficult. The rolling condition in the hot rolling may be in accordance with a usual method and is not particularly limited.

When the magnetic properties are considered important, it is preferable to conduct a hot band annealing to the hot-rolled sheet obtained by the hot rolling. The soaking condition in the hot-band annealing is preferably at 950° C. to 1080° C. for 20 to 180 seconds. This is because the effect by the hot-band annealing cannot be sufficiently obtained when the temperature is lower than 950° C. or the time is less than 20 seconds, while the crystal grains are extremely coarsened and may cause sheet breakage in the cold rolling when the temperature exceeds 1080° C. or the time exceeds 180 seconds.

Then, the steel sheet after a hot rolling or after a hot-band annealing is pickled to remove scales, and formed into a cold-rolled sheet with a final thickness by one cold rolling or two or more cold rollings having an intermediate annealing between each rolling. The cold rolling (final cold rolling) for rolling the sheet to the final thickness is the most important process in accordance with aspects of the present invention, and needs to be conducted by using a tandem rolling mill at a total rolling reduction of not less than 80%. When the total rolling reduction is less than 80%, good primary recrystallization texture cannot be obtained. The total rolling reduction is preferably not less than 85%.

Moreover, it is important to promote the inter-pass aging by applying warm rolling to the final cold rolling. As described above, however, the pass time of the steel sheet between the stands cannot be sufficiently ensured in a usual tandem rolling mill, and accordingly the pass time aging cannot be effectively utilized. In accordance with aspects of the invention, therefore, it is important to use a tandem rolling mill equipped with a pass line extension mechanism which can extend the length of the steel sheet S (pass line length) present between the stands, as shown in FIG. 2. The manner for extending the pass line is not particularly limited, but as shown in FIG. 2 described above, can preferably use a method of extending the pass line length effectively by moving a plurality of movable rolls, which are arranged on the opposite side with respect to the reference horizontal pass line, upward and downward.

It is preferable that the pass line extension mechanism be capable of extending the pass line length of the steel sheet between the stands to not less than 1.3 times longer than that in a normal rolling, i.e. not less than 1.3 times longer than the inter-stand distance L. That is because extending the pass line length to not less than 1.3 times longer than the inter-stand distance L attains remarkable effect by the inter-pass aging as shown in FIG. 1 described above. It is more preferably not less than 1.5 times. In this regard, the longer the aging time is, the more the texture improvement effect by the inter-pass aging is developed, and for example, the effect can be recognized even by the long aging time of 5 or more minutes. However, the aging time exceeding 8 seconds tends to cause the effect to be saturated. Therefore, it is preferably to 8 seconds at longest that the pass line extension mechanism extends the inter-pass time between the stands. When the productivity is considered important, the inter-pass aging time is preferably not longer than 4 seconds.

The texture improvement effect can be obtained by inter-pass aging between the stands in any stage, and as shown in FIG. describe above, is more remarkable between the stands in the later stage of the tandem rolling mill where the dislocation density introduced by rolling is high. Accordingly, it is preferable to dispose the pass line extension mechanism between the stands in the later stage where the total rolling reduction is not less than 66%.

For the development of the inter-pass aging, carbon and nitrogen in the steel sheet needs to be diffused, for which it is necessary to perform warm rolling for rolling after the steel sheet itself is previously heated to a certain temperature or higher before rolling in the tandem rolling mill. The temperature of the steel sheet needs to fall within the range of 150 to 280° C., preferably in the range of 180 to 280° C. The method for heating the steel sheet is not particularly limited, and may use any one of an induction heating, direct electric heating, and radiation heating by an electric heater and the like. In the later stages of the tandem rolling mill, the heat generated in working by the rolling can also be used. Moreover, since the pass line extension mechanism is provided in accordance with aspects of the present invention, the steel sheet can be heated stably and efficiently by providing the roll used for the pass line extension with a heating function. The method of heating the roll is not particularly limited as long as a steel strip can be heated by heat transfer, and can preferably use, for example, a roll having an electric resistance heater or an induction-heating type heater therein, or a roll that is heated by feeding a medium such as a hot gas therein.

The cold-rolled sheet rolled to the final thickness is thereafter subjected to primary recrystallization annealing also working as decarburization. The purpose of the primary recrystallization annealing is to cause the cold-rolled sheet having rolled texture to be recrystallized and adjusted so as to have primary recrystallized texture and a grain size both of which are optimum for secondary recrystallization; to set the annealing atmosphere to an oxidizing wet-hydrogen atmosphere such as wet hydrogen-nitrogen atmosphere or wet argon hydrogen atmosphere so that carbon in the steel is reduced to an amount (not more than 0.005 mass %) by which magnetic aging is not cause; and further to form a moderate oxide film on the steel sheet surface. In order to attain the above purpose, it is preferable that the primary recrystallization annealing be conducted at 750 to 900° C. under a wet hydrogen atmosphere which is most suitable to the decarburization.

After subjected to the primary recrystallization annealing, the steel sheet is coated with an annealing separator on the surface, dried and subjected to finishing annealing. The annealing separator is preferable to contain mainly Magnesia (MgO) to form forsterite coating on the steel sheet surface after the finishing annealing. Moreover, the addition of an appropriate amount of Ti oxide or Sr compound or the like as an auxiliary agent in the annealing separator favorably works for the formation of forsterite coating with excellent coating properties. In particular, the additions of $TiO_2$, $Sr(OH)_2$, $SrSO_4$. and the like, which are an auxiliary agent that uniforms the formation of the forsterite film, are also advantageous for an improvement in stripping resistance.

The finishing annealing subsequent to the application of the annealing separator is performed to develop secondary recrystallization and form the forsterite coating. The atmosphere for the finishing annealing can use any one of $N_2$ gas, Ar gas, $H_2$ gas or the mixed gas therewith. In order to cause the secondary recrystallization more stably, it is preferable to hold the same temperature around just above the secondary recrystallization temperature. Instead of the isothermal holding, the steel sheet may be heated with a slower heating rate in the temperature range near the secondary recrystallization temperature, whereby the same effect can be obtained. After the secondary recrystallization is completed, it is preferable to heat the steel sheet to not lower than 1100° C. to discharge the inevitable impurities, which badly affect the magnetic properties of the product sheet, and conduct purification treatment thereto. The purification treatment allows Al, N, S and Se in steel to decrease to the level as the inevitable impurities.

It is preferable to perform flattening annealing of the steel sheet after the finishing annealing to correct winding curl caused in the finishing annealing. The steel sheet surface after the finishing annealing may be also coated with an insulation coating and baked according to the use. The kind of the insulation coating and the coating method are not particularly limited, but preferably use, such a method described in, for example, JP-A-S50-79442 and JP-A-S48-39338 that a tension-imparting insulation coating containing phosphate, chromate and colloidal silica is applied to the steel sheet surface and baked at approximately 800° C. The baking of the insulation coating may be conducted combined with the flattening annealing.

Example 1

A steel slab having a chemical composition comprising C: 0.045 mass %, Si: 3.15 mass %, Mn: 0.04 mass %, sol. Al: 0.0030 mass %, N: less than 0.0025 mass %, S, Se and O: less than 0.0050 mass % each and the residue being Fe and inevitable impurities and containing no inhibitor-forming components is reheated to 1100° C., hot rolled to form a hot-rolled sheet with a sheet thickness of 2.0 mm, and subjected to hot-band annealing at 1000° C. for 60 seconds. The steel sheet after the hot-band annealing is descaled and then subjected to final cold rolling using a 4-stand tandem rolling mill provided with a pass line extension mechanism according to aspects of the invention shown in FIG. 2 to form a cold-rolled sheet with a final sheet thickness of 0.30 mm (total rolling reduction: 85%).

The final cold rolling is conducted under three conditions: a rolling condition 1 that is the same as in prior arts and applies no pass line extension mechanism; a rolling condition 2 that rolling is conducted at stand #1 with a rolling reduction of 38% and a pass line extension mechanism is applied between stand #1 and stand #2; and a rolling condition 3 that rolling is conducted from stand #1 to stand #3 at a total rolling reduction of 78% and a pass line extension mechanism is applied between stand #3 and stand #4. The pass line length is extended to 1.5 times longer than the inter-stand distance L between the stands where the pass line extension mechanism is applied. Moreover, the steel sheet temperature is controlled to 200° C. by adjusting the rolling oil amount between stand #1 and stand #2 in the experimental conditions 1 and 2, and between stand #3 and stand #4 in the experimental condition 3.

The cold-rolled sheet with the final sheet thickness of 0.30 mm is then subjected to primary recrystallization annealing working also as decarburization at 840° C. for 100 seconds. A sample specimen is taken out from the steel sheet after the primary recrystallization annealing, and subjected to X-ray diffraction to obtain pole figures, from which an ODF is prepared by a ADC method, and the {110}<001> strength value at (Φ, φ1)=(90°, 90°) in the Φ2=45° section is determined to evaluate the recrystallized texture.

The steel sheet after the primary recrystallization annealing is coated with an annealing separator mainly composed of MgO, subjected to finish annealing for developing secondary recrystallization, coated with an insulation coating containing phosphate, chromate, and colloidal silica by a mass ratio of 3:1:2, followed by baking, and subjected to stress-relief annealing at 800° C. for 3 hour.

From the central portion of the thus obtained steel sheet after the stress-relief annealing, sample specimens with a width: 30 mm and a length: 280 mm are taken out in the rolling direction and in the widthwise direction thereof, at a total amount of not less than 500 g, and are subjected to an Epstein test to measure iron loss $W_{17/50}$.

FIG. 3 shows the measurement result. As seen from the result, the primary recrystallized texture is improved by applying the cold rolling method according to aspects of the present invention, thereby to further improve the magnetic properties (iron loss property) of a product sheet than before. Moreover, it can be seen that aspects of the present invention can exhibit its effect more efficiently when applied to the stage where the total rolling reduction exceeds 66% (between stand #3 and stand #4) than when applied to the stage where the total rolling reduction is not more than 66% (between stand #1 and stand #2).

TABLE 3

| Rolling condition | Arrangement position of pass line extension mechanism | Steel sheet properties {110}<001> strength | Iron loss $W_{17/50}$ (W/kg) | Remarks |
|---|---|---|---|---|
| 1 | No arrangement | 0.22 | 1.033 | Comparative Example |
| 2 | Between stands #1 and #2 | 0.26 | 1.012 | Invention Example |
| 3 | Between stands #3 and #4 | 0.29 | 0.988 | Invention Example |

Example 2

A steel slab having a chemical composition comprising C: 0.040 mass %, Si: 3.3 mass %, Mn: 0.05 mass %, sol. Al: 0.0090 mass %, N: less than 0.0050 mass %, S, Se and O: less than 0.0050 mass % each, optionally, a component shown in FIG. 4 as an arbitrary additional element, and the residue being Fe and inevitable impurities is reheated to 1200° C., hot rolled to form a hot-rolled sheet with a sheet thickness of 2.5 mm, and subjected to hot-band annealing at 1000° C. for 60 seconds. The steel sheet after the hot-band annealing is descaled and then cold rolled for the first time to the intermediate sheet thickness of 1.5 mm, subjected to an intermediate annealing at 1030° C. for 100 seconds, and subjected to the second cold rolling (final cold rolling) using a 4-stand tandem rolling mill to form a cold-rolled sheet with a final sheet thickness of 0.22 mm.

The final cold rolling is conducted in a condition that the rolling reduction of each stand is set to 38% (constant) and the pass line extension mechanism shown in FIG. 2 is applied between stands #3 and #4 so that the pass line length between stand #3 and stand #4 is extended to 1.5 times longer than the inter-stand distance L. In each case, the rolling oil amount is suppressed so that the steel sheet temperature on the exit side of stand #3 exceeds 200° C., and moreover, in the case where the pass line extension mechanism is disposed, one of the movable rolls for changing the pass line provided between stand #3 and stand #4 is equipped with a heating function and heats the steel sheet to 250° C.

The cold-rolled sheet with the final sheet thickness is then subjected to primary recrystallization annealing working also as decarburization at 850° C. for 40 seconds under a wet hydrogen atmosphere, coated with an annealing separator mainly composed of MgO, and subjected to finish annealing for causing secondary recrystallization. The steel sheet after the finish annealing is further coated with an insulation coating containing phosphate, chromate and colloidal silica by a mass ratio of 3:1:2 and baked in flattening annealing at 850° C. for 30 seconds. From a portion corresponding to the outermost roll of the coil in the finish annealing, sample specimens with a width: 30 mm and a length: 280 mm are taken out in the rolling direction and in the widthwise direction thereof, at the total amount of not less than 500 g, and are subjected to an Epstein test to measure iron loss $W_{17/50}$.

FIG. 4 shows the obtained results. As seen from the FIG. 4, the iron loss property is improved by applying the cold rolling method according to aspects of the invention, and further improved by adding at least one selected from Ni, Sn, Nb, Mo, Sb, Cu, P, Cr, and Bi in a proper amount, as an arbitrary addition element.

TABLE 4

| Steel Sheet No. | Chemical composition (mass %) Ni | Sn | Nb | Mo | Sb | Cu | P | Cr | Bi | Application position for pass line extension mechanism | Iron loss $W_{17/50}$ (W/kg) | Remarks |
|---|---|---|---|---|---|---|---|---|---|---|---|---|
| 1 | — | — | — | — | — | — | — | — | — | No application | 0.912 | Comparative Example |
| 2 | — | — | — | — | — | — | — | — | — | Between std #3 and #4 | 0.885 | Invention Example |
| 3 | 0.05 | 0.01 | — | 0.01 | — | — | 0.05 | — | — | Between std #3 and #4 | 0.854 | Invention Example |
| 4 | — | — | — | — | 0.010 | 0.05 | 0.10 | — | — | Between std #3 and #4 | 0.847 | Invention Example |
| 5 | — | 0.01 | — | — | — | — | — | 0.03 | — | Between std #3 and #4 | 0.858 | Invention Example |
| 6 | — | — | 0.005 | — | 0.015 | — | 0.08 | — | — | Between std #3 and #4 | 0.850 | Invention Example |
| 7 | 0.05 | — | — | 0.01 | 0.015 | — | — | 0.05 | 0.001 | Between std #3 and #4 | 0.862 | Invention Example |

INDUSTRIAL APPLICABILITY

The method according to aspects of the present invention is not limited to the field of a grain-oriented electrical steel sheet using an inhibitor-less steel material, and is preferably applicable to a technical field requiring inter-pass aging, or demanding proper pass time, such as the field of a grain-oriented electrical steel sheet, non-oriented electrical steel sheet, and cold-rolled sheet utilizing an inhibitor.

REFERENCE SIGNS LIST

1: backup roll
2: work roll
3: fixed roll
4: movable roll
S: steel sheet
L inter-stand distance

What is claimed:

1. A method of producing a grain-oriented electrical steel sheet comprising reheating a steel slab comprising C: 0.01 to 0.10 mass %, Si: 2.0 to 4.5 mass %, Mn: 0.01 to 0.5 mass %, sol. Al: not less than 0.0020 mass % and less than 0.0100 mass %, N: less than 0.0080 mass %, each of S, Se, and O: less than 0.0050 mass %, and the balance being Fe and inevitable impurities to a temperature of not higher than 1300° C., subjecting the slab to hot rolling and then one cold rolling or more cold rollings having an intermediate annealing between each rolling to form a cold-rolled sheet with a final thickness, and subjecting the cold-rolled sheet to a primary recrystallization annealing working also as decarburization and to a final annealing causing secondary recrystallization after applying an annealing separator on the surface of the steel sheet, characterized in that the final cold rolling for cold rolling the steel sheet to the final thickness is performed by using a tandem rolling mill such that at a total rolling reduction is not less than 80% and at least one of the sheet temperatures between stands thereof is within 150 to 280° C. and by extending a pass line length of the steel sheet between the stands so as to satisfy the following equation (1):

$$T \geq 1.3 \times L/V, \quad (1)$$

where a distance between the stands is defined as L(m), a speed of the steel sheet passing between the stands is defined as V (mpm), and a pass time during which the steel sheet passes between the stands is defined as T(min).

2. The method of producing a grain-oriented electrical steel sheet according to claim 1, wherein the extension of the pass line length of the steel sheet is performed between the stands where the total rolling reduction reaches not less than 66%.

3. The method of producing a grain-oriented electrical steel sheet according to claim 1, wherein the steel slab further contains one or more selected from Ni: 0.005 to 1.50 mass %, Sn: 0.005 to 0.50 mass %, Nb: 0.0005 to 0.0100 mass %, Mo: 0.01 to 0.50 mass %, Sb: 0.005 to 0.50 mass %, Cu: 0.01 to 1.50 mass %, P: 0.005 to 0.150 mass %, Cr: 0.01 to 1.50 mass %, and Bi: 0.0005 to 0.05 mass %.

4. The method of producing a grain-oriented electrical steel sheet according to claim 2, wherein the steel slab further contains one or more selected from Ni: 0.005 to 1.50 mass %, Sn: 0.005 to 0.50 mass %, Nb: 0.0005 to 0.0100 mass %, Mo: 0.01 to 0.50 mass %, Sb: 0.005 to 0.50 mass %, Cu: 0.01 to 1.50 mass %, P: 0.005 to 0.150 mass %, Cr: 0.01 to 1.50 mass %, and Bi: 0.0005 to 0.05 mass %.

* * * * *